US006264768B1

(12) United States Patent
Sonti et al.

(10) Patent No.: US 6,264,768 B1
(45) Date of Patent: Jul. 24, 2001

(54) METHOD FOR STRENGTHENING OF ROLLING ELEMENT BEARINGS BY THERMAL-MECHANICAL NET SHAPE FINISH FORMING TECHNIQUE

(75) Inventors: Nagesh Sonti; Suren B. Rao, both of State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/298,375

(22) Filed: Apr. 23, 1999

(51) Int. Cl.[7] ..... C21D 1/10

(52) U.S. Cl. ..... 148/567; 148/571; 148/573; 148/575; 148/586; 148/589; 266/129; 266/130

(58) Field of Search ..... 266/81, 92, 129, 266/130; 148/573, 574, 575, 586, 571, 589

(56) References Cited

U.S. PATENT DOCUMENTS

| | | | |
|---|---|---|---|
| 5,221,513 | 6/1993 | Amateau | 266/81 |
| 5,451,275 | 9/1995 | Amateau et al. | 148/573 |

*Primary Examiner*—Sikyin Ip
(74) *Attorney, Agent, or Firm*—Perman & Green, LLP

(57) ABSTRACT

A method and apparatus disclosed for cost-effective net shape precision ausform finishing the engagement surfaces of ball and roller bearings, for enhancing the surface strength and durability of bearing inner and outer races. The method consists of induction heating to austenitize the contacting surface layers of rolling element bearing races, followed by martempering (or marquenching), and then net shape roll finishing of the induction heated contacting surface layers in the metastable austenitic condition to finished dimensional accuracy requirements, and finally cooling to martensite. The apparatus utilizes a fixed vertical through-feed axis for the workpiece bearing race with capability for rotation and linear up and down positioning motion, and two coordinated and controlled laterally-moving infeed axes for roll finishing tooling dies. For finishing of the outer contacting surfaces of the bearing inner races, two suitably contoured power-driven dies are arranged symmetrically on diametrically opposing sides of the workpiece. A dual but asymmetric tooling arrangement employs a suitably contoured power-driven finish tooling die is positioned for the internal roll finishing operation, while a plane cylindrically shaped idling support tooling die is located on the opposing side of the work region. The apparatus includes specialized contoured finishing tooling for bearing inner and outer race ausform finishing utilizing specially contoured cylindrical roll finishing tolling dies to facilitate infeed ausforming of bearing inner and outer races, the structure and mechanism for asymmetric mounting, powered drive and infeeding of the roll finishing die and the idling support die with respect to the bearing outer race.

37 Claims, 11 Drawing Sheets

A–AUSTENITE
C–CEMENTITE
F–FERRITE
M–MARTENSITE
MA–METASTABLE AUSTENITE

METHOD FOR STRENGTHENING OF ROLLING ELEMENT BEARINGS BY THERMAL-MECHANICAL NET SHAPE FINISH FORMING TECHNIQUE

BACKGROUND OF THE INVENTION

1. Field of the Invention

The present invention relates to a method and apparatus for net shape precision ausform finishing of rolling element bearing races by controlled induction heating and deformation devices to produce contacting surfaces with enhanced strength and durability by the application of thermal-mechanical techniques.

2. Description of the Prior Art

Ball and roller element bearings are critical machine components used in high performance drive train transmissions, and are heavily loaded with contact stresses of up to 250 K psi while operating over a broad speed range. Such rolling element bearing races require high surface strength for resisting contact fatigue, wear and plastic deformation, as well as high strength and toughness in the core with adequate fracture and crushing resistance. Furthermore, bearing races must be precision finished to high dimensional accuracy and fine surface finish to ensure interchangibility of parts and to minimize vibration and fatigue loading. Such a combination of mechanical properties and dimensional accuracy is achieved utilizing a complex manufacturing process sequence consisting of initial rough machining to approximate size, heat treatment to achieve the desired gradient of mechanical properties, and finally hard grinding and related processing steps for precision finishing to final dimensions. Optimal material properties exist in the as-hardened condition in terms of its surface fatigue response. However, the beneficial as-hardened near surface layers are removed by hard grinding to achieve the desired dimensional accuracy, thereby redressing the prior manufacturing errors and heat treatment distortions. Hard grinding is expensive and can be detrimental if grinding cracks and burns are produced due to abusive practice, requiring etching type inspection techniques, thereby further adding to production cycle time and costs. A method and associated apparatus are disclosed for integral surface heat treatment and precision finishing of rolling element bearing races, thereby eliminating the need for traditional hard grinding and related finishing operations.

The process disclosed by this invention, utilizes contour induction heating to austenitize the surface layers of the bearing races, followed by rapid quenching in marquenching oil maintained at appropriate temperature of up to about 600° F. to achieve a metastable austenitic condition in the surface layers. The surface layers in this metastable austenitic condition are then precision ausform finished to final dimensions and then quenched for transformation to martensite. The bearing race ausform finishing thus integrates the surface induction heating process with a precision roll finishing operations to net shape finish the contacting surfaces of roller element bearing inner and outer races.

Most bearing races are made of high carbon through-hardening type steels such as AISI-52100, whereas bearings used in more heavily loaded and critical transmissions are made of low carbon low-alloyed steels such as AISI-8620 which are case-carburized to produce a hardened case combined with a tough core. The present invention is applicable to both through hardening and carburizing grade bearing steels. Through-hardening steels are traditionally hardened by first austenitizing or heating over the upper critical temperature (approximately 843° C. or 1550° F.), and then rapidly quenching to about the room temperature or below to achieve desired martensitic transformation, followed by a tempering cycle to toughen the core material. The microstructure of such quenched and tempered AISI-52100 comprises plate martensite, alloy carbides and retained austenite; the surface hardness and amount of retained austenite depends upon the tempering temperature used. The heat treatment of carburizing grade surface hardening type steels require additional processes to case-carburize the components prior to the hardening and tempering steps. For through hardening steels, the present invention has the additional advantage of eliminating all batch manufacturing operations such as furnace heat treatment for hardening, and instead in-line induction heating and integral quenching is used.

It was with knowledge of the foregoing state of the technology that the present invention has been conceived and is now reduced to practice.

SUMMARY OF THE INVENTION

In accordance with the present invention, there is provided a method and apparatus for precision ausform finishing of bearing inner and outer races, utilizing a fixed vertical through-feed axis for the workpiece bearing race with capability for rotation and linear up and down positioning motion, and two coordinated and controlled laterally-moving infeed axes for roll finishing tooling dies. For finishing of the outer contacting surfaces of the bearing inner races, the method of the invention utilizes two suitably contoured power-driven dies arranged symmetrically on diametrically opposing sides of the workpiece. However, for finishing the inner contacting surfaces of the bearing outer races, a dual but asymmetric tooling arrangement will be described. In this case, a suitably contoured power-driven finish tooling die is positioned for the internal roll finishing operation, while a plane cylindrically shaped idling support tooling die is located on the opposing side of the work region. The apparatus disclosed in the present invention includes specialized contoured finishing tooling for bearing inner and outer race ausform finishing, and specifically required modifications to the present double die ausform finishing machine, previously described in commonly assigned U.S. Pat. No. 5,451,275 to Amateau et al. issued Sep. 19, 1995, in order to achieve precision ausform finishing of rolling element bearing inner and outer races. The apparatus includes the structure and mechanism for specially contoured cylindrical roll finishing rolling dies to facilitate infeed ausforming of bearing inner and outer races, the structure and mechanism for asymmetric mounting, powered drive and infeeding of the roll finishing die and the idling support die with respect to the bearing outer race.

The bearing race ausform finishing process disclosed herein is applicable to a variety of precision roller element bearing races including ball, roller and taper roller bearings. The precision finishing of bearing raceways results in enhanced strength induced in the contacting surfaces due to ausforming or plastic deformation of the metastable austenite, and thereby has the potential to significantly improve the surface fatigue strength of bearing elements inner and outer races. Ausforming of cylindrical rolling contact fatigue testing specimens made of AISI 9310 has demonstrated improved metallurgical characteristics such as finer grained microstructure and higher compressive residual stresses, combined with smoother surface finish of 6–8 $\mu$in Ra without hard grinding, and has been shown to improve the surface fatigue behavior as compared to conventional hard grinding techniques.

The invention also includes the ability for effecting dual frequency contoured induction preheating and austenitization of the bearing surface layers being ausform finished, using annular outer and inner coils each for inner and outer bearing races, respectively, and comprising automated power switching devices for furnishing the low audio frequency power for induction preheating and high radio frequency power for induction austenitization of the bearing race contacting surface layers. The invention includes the process for controlled preheating and final heating cycles to achieve the desired depth of austenitized surface layers and thermal gradients beneath the austenitized layers for surface layers ausforming cycle. Furthermore, the apparatus of the invention includes the use of a single annular contoured internal coil for a dual frequency, two cycle preheating and final heating (austenitization) of the inner contacting surface of the bearing outer race, and also a single annular contoured external coil for dual frequency preheating and final heating (ausenitization) of the outer contacting surfaces of the bearing inner races. Additionally, a suitable mechanism is provided to position the individual workpieces for the induction beating cycle and then to transfer and position the work pieces for the precision ausform roll finishing cycle.

The invention includes appropriate mechanisms for achieving controlled deformation and for precision alignment of the tooling axes with reference to the workpiece portioning axis, a processing tank and quenching medium maintained at the processing temperature, desirably under an inert atmosphere, to achieve the desired metastable austenitic condition in the bearing working surface layers after the dual frequency induction heating cycle, and mechanisms for performing timely transfer of the workpiece to achieve the optimum metallurgical condition at each stage of the ausform finishing process and structure and mechanism for final quenching of the bearing races to transform the deformed metastable austenite to martensite.

High strength metal components are often fabricated either from a medium-to-high carbon low alloy steel or from a low carbon alloy carburizing grade steel in which the surface and sub-surface regions have been enriched with carbon to a specified depth. The higher carbon content serves to increase the hardness and to strengthen the material along the contacting surfaces and beneath the surface. The elevation in hardness results from transformation during quenching of the steel from the face centered cubic crystal structure known as austenite to the body centered tetragonal crystal structure of very fine grain size known as martensite. Less hard but tougher properties can be obtained by isothermal transformation to bainite or a mixture of bainite and martensite upon quenching.

In a conventional processing method for producing rolling element bearing races, the austenitized workpiece is quenched rapidly through the austenitic region by immersion into quenching media below the MF temperature. The workpiece is subsequently tempered at a designated temperature to soften the structure and impart ductility. After the tempering treatment is complete, finishing is accomplished by grinding in a well known manner for high performance rolling element bearing races.

As mentioned above, the present invention eliminates the grinding operation to provide a microstructurally improved rolling element engagement surface as will now be described. An important part of this invention is to select a through hardening grade or a carburizing grade steel which has a transformation curve with a metastable austenitic condition just above the martensitic range for a period of time sufficiently long to allow shaping of the gear teeth surfaces. There is shown in FIG. 1 a generic time-temperature-transformation chart for carburized steel. A similar t-t-t chart exists also for the through hardening type steel used for bearing applications such as 52100 steel.

The time-temperature-transformation curve shows the times required for austenite to start and to complete transformation at each temperature. Temperature is indicated along the ordinate and time on a logarithmic scale is indicated along the abscissa. The thermal excursion of the present invention is also depicted in FIG. 1.

After the workpiece is heated above its critical temperature to an initial temperature 20, or approximately 1500° F., to render it austenitic, it is rapidly quenched (marquenched) from point 22 to point 24 at a rate exceeding a critical cooling rate in a liquid medium such as a standard marquenching oil which is maintained just above the temperature at which martensite starts to form and metastable austenite is obtained. A critical cooling rate is defined by the slope of line 22–24 that avoids the nose 26 of the transformation curve where austenite and cementite start to form.

To allow the maximum time for mechanically operating on the surfaces of a workpiece while in the metastable austenitic condition, the cooling step must terminate temporarily at a temperature just above the martensitic condition. In FIG. 1, the point 24 beginning a new temperature plateau ending at point 28 is shown positioned at about 450° F.

Shaping of bearing element races further in accordance with this invention employs a process which is performed between points 24 and 28 whereby swaging or rolling or other operations are used to shape the bearing element races by deforming the metastable austenitic layer prior to and before its conversion to martensite. This occurs during a pre-transformation time interval at a temperature below that for recrystallization of austenite and just above the Ms of the layer. This process, to be described, presents a structure and mechanism of developing ultra high strength in the current bearing element races processed by the conventional heat treatment.

Following the shaping operation, the bearing element race is transferred to a quench station, as indicated in FIG. 1 by line 28–30. Final quench, preferably utilizing a pressurized gas stream, although a liquid is within the scope of the invention, is initiated at point 30 and is finalized at point 32 in the martensitic range.

A control subsystem for the invention, under the primary supervision of a microprocessor, may comprise both hardware and software supervising and controlling the thermomechanical operations. In this scenario, all of the functions necessary for the operation of the mechanical, environmental and thermal functions of the apparatus would be controlled from this computer. The machine operator has a choice of operating each function of the machine separately or initiating a sequence of operations that will actually perform the thermomechanical forming operation. The software is constructed in such a way that each separate function cannot proceed until a requisite condition exists in the apparatus.

A primary feature, then, of the present invention is the provision of a method and apparatus for net shape precision ausform finishing of hardened rolling element bearing races by controlled induction heating and deformation devices to produce contacting surfaces with enhanced strength and durability by thermal-mechanical techniques.

Another feature of the present invention is the provision of a method and apparatus for net shape precision ausform finishing of ball and roller bearings, thereby inducing ausform strengthening in localized contacting surface layers of bearing races.

Still another feature of the present invention is the provision of a method utilizing specially contoured roll finishing dies to achieve the precise finished geometry of the contacting surface of the bearing races, taking into account the elastic and plastic deformations and deformation gradients induced in the races.

A further feature of the present invention is the provision of apparatus for controlled deformation of the rolling element bearing inner and outer races utilizing symmetric double die design for the inner races and asymmetric double die design for the bearing outer races.

Yet a further feature of the present invention is the provision of a method and apparatus for dual frequency contoured induction austenitization of bearing inner and outer races including the low audio frequency preheating and high radio frequency final heating, utilizing individual annular internal or external induction coils for bearing outer and inner races, respectively, and associated automated switching means for furnishing the appropriate power to the coils.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENT

Figure 1:
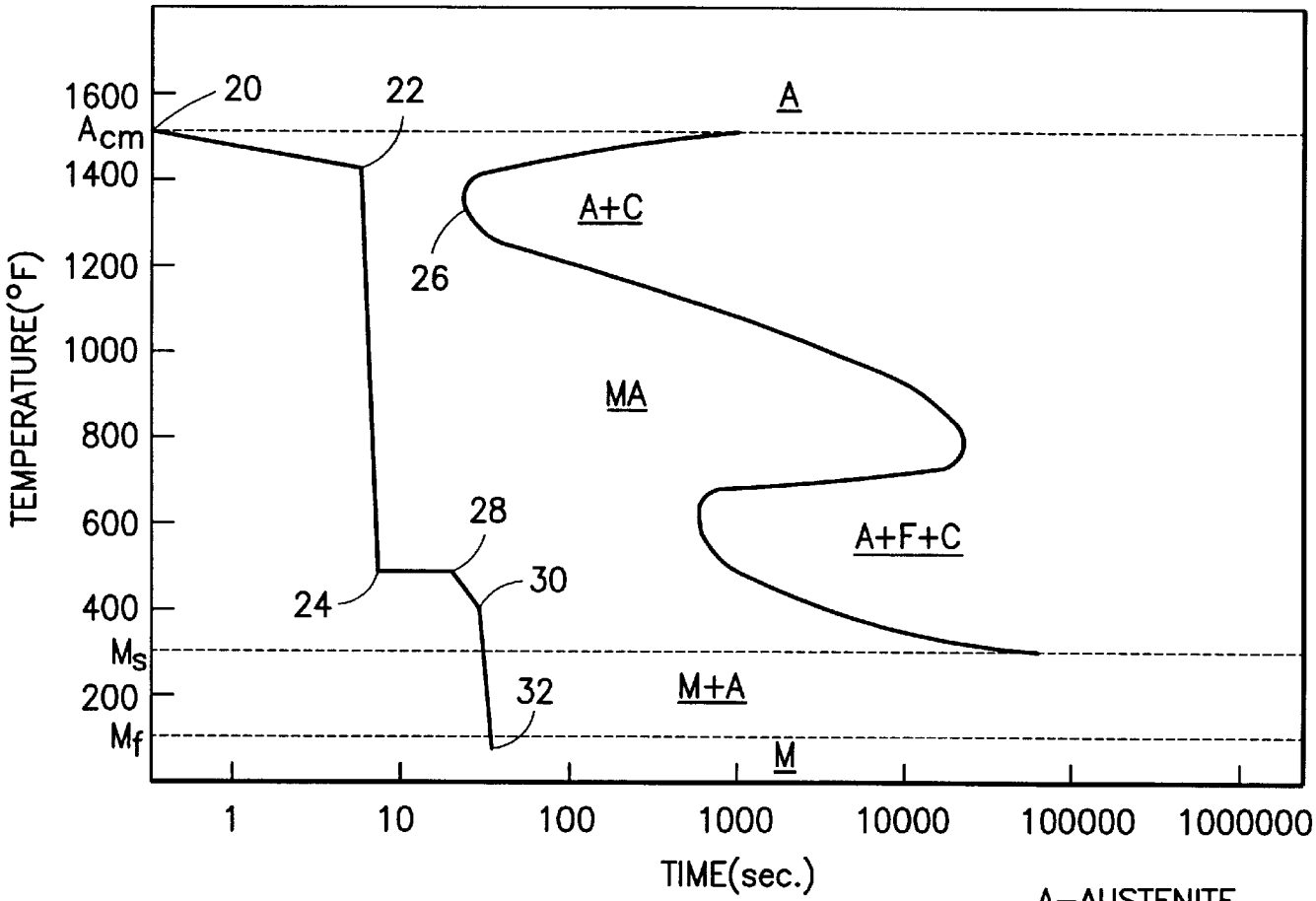
FIG. 1 is a Time-Temperature-Transformation (T-T-T) Diagram of a typical low alloy steel, used for making hardened rolling element bearing races in accordance with the invention.

The basic concept as presently disclosed is to thermo-mechanically roll finish surface layers and thereby induce ausform strengthening in the bearing raceways. This enhanced strength can result in substantially increased load capability and, therefore, improved performance and life of bearings. Attempts were made in the mid 1960s and 1970s to ausform bearing components. Entire inner and outer races and their associated balls were forged or bulk ausformed. Small 35 mm bore bearings were produced in this manner and tested and found to have up to seven fold increase in life. However, a very large forging capability was required to bulk forge the components, and several subsequent mechanical operations were necessary to achieve required dimensional accuracy and surface finish. The very large forging capability required was not cost-effective, and therefore the process was not industrially implemented. Furthermore, this technique was suitable only for high carbon through-hardening steels such as M-50 or 52100 steels.

The approach of the present invention eliminates all of the above problems. First, by the thermo-mechanical roll finishing concept, ausforming is applied only to the outer surface layers, thus substantially reducing the load requirements. As it is a net shape finishing operation with capability to achieve the final dimensional accuracy and surface finish sought, no further operations are required. Finally, since only the surface layers are induction heated and then ausform finished, the technique is also applicable to carburizing grade bearing steels, in addition to the through-hardening steels.

It may seem that once precision roll finishing a complex geometry such as a spur/helical gear has been successfully achieved, it would be a relatively straightforward task to roll finish a simpler cylindrical/conical geometry. In fact, the opposite is true considering the deformation and material flow patterns involved with these distinctly different component shapes, and to the best knowledge of the inventors, cylindrical/conical surfaces (either internal or external surfaces) have never been precision roll finished. Net shape finishing by rolling for gears as described in commonly assigned U.S. Pat. Nos. 5,451,275 and 5,221,513 to Amateau et al., the disclosures of which are hereby incorporated herein in their entirety by reference, utilizes a combined rolling and sliding action between meshing gears teeth. The sliding action occurs up and down the tooth surfaces, and that sliding action is exploited to induce material flow up and down the teeth. As the gear tooth surface is soft in the metastable austenitic state, rolling the gear under lateral load against a hard rigid die gear, produces material flow along the sliding direction. Therefore the controlled lateral infeed motion of the dies results in meshing tooth loads both tangential and normal to the tooth surfaces of the work gear which induces plastic deformation on the gear teeth.

For cylindrical and conical surfaces such as rolling element bearing races, however, there is no substantial sliding action and the lateral in feed loads produce compressive and axial shear material flow in the surface layers. Material flow patterns are therefore more complex, as the only path available for the plastic flow from the surface layers is in the axial direction. Material from regions near the edges can easily flow outwards, whereas material from the mid-regions must be induced to flow out over a substantially larger distance. Rolling die design is therefore more involved in order to allow for varying amount of axial flow material flow from the mid regions to the ends. Even for a straight cylindrical surface, the profiles of the rolling dies must be suitably contoured to achieve the desired precision and surface finish in the finished component. Rolling die design is further complicated for contoured cylindrical and conical surfaces.

Figure 2:
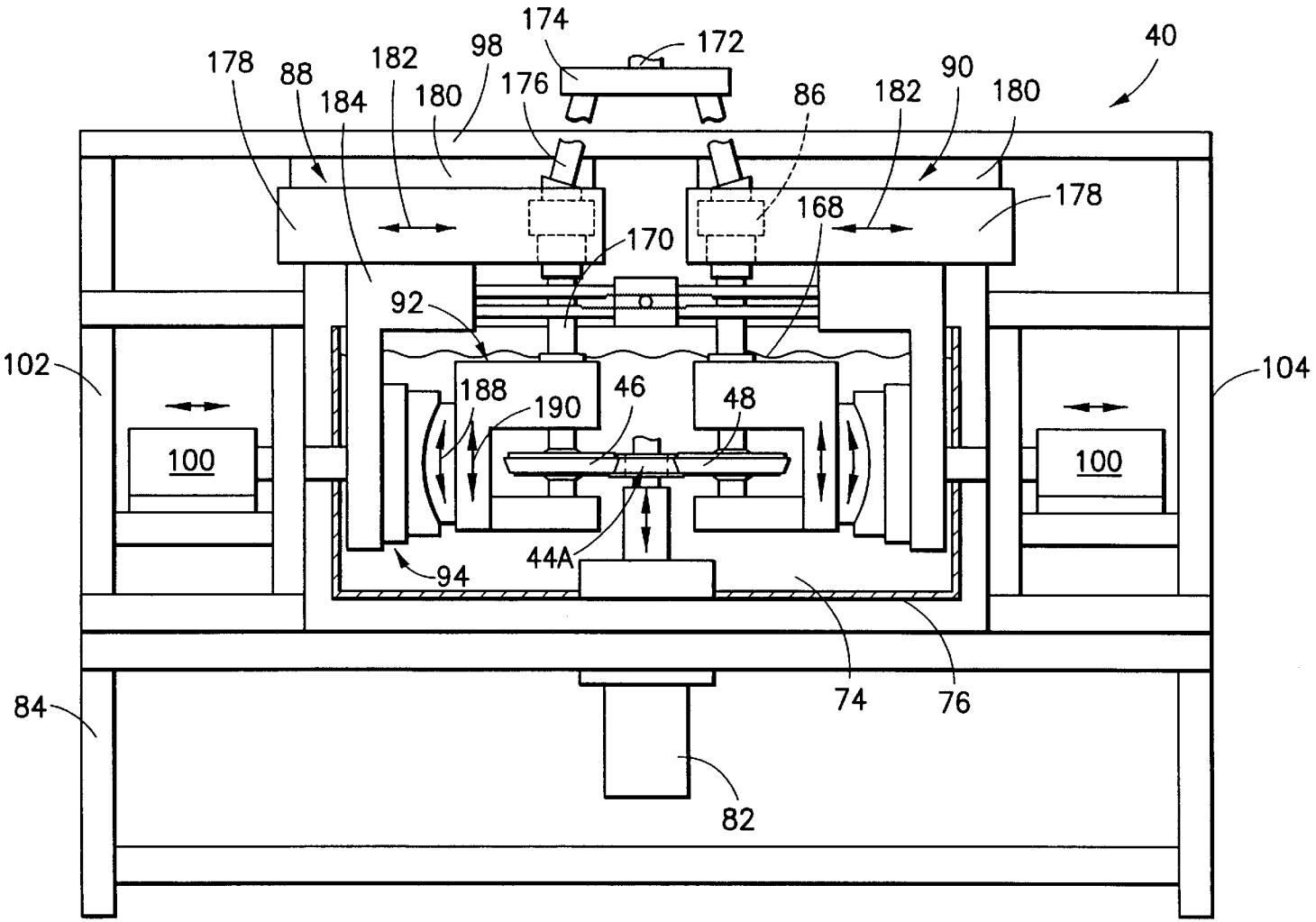
FIG. 2 is a diagrammatic front elevation view of apparatus for rolling element bearing race processing as embodied by the invention, the procedure being indicated for one component of the rolling element bearing race.
Figure 3:
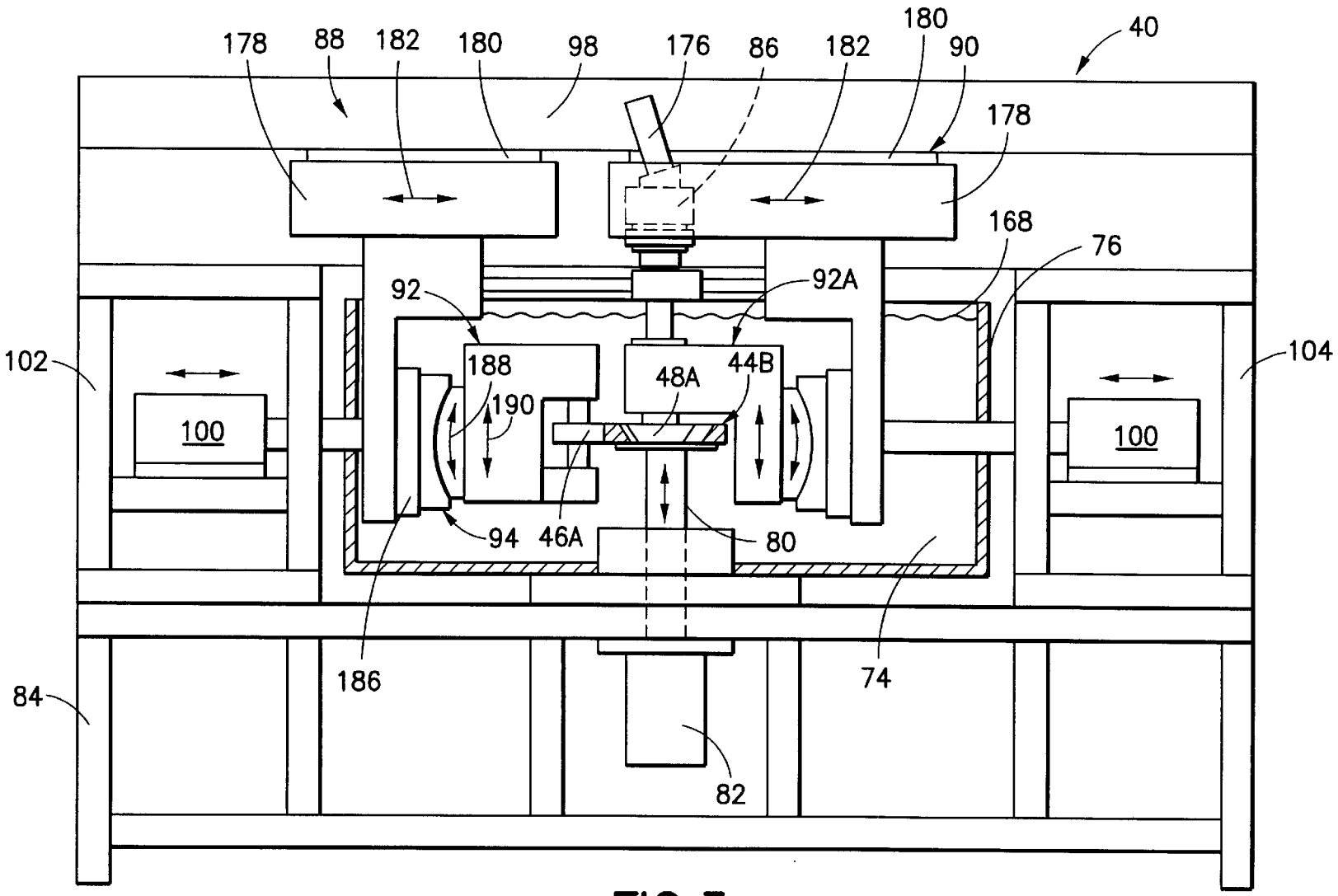
FIG. 3 is a diagrammatic front elevation view, similar to FIG. 2, the procedure being indicated for another component of the rolling element bearing race.
Figure 4:
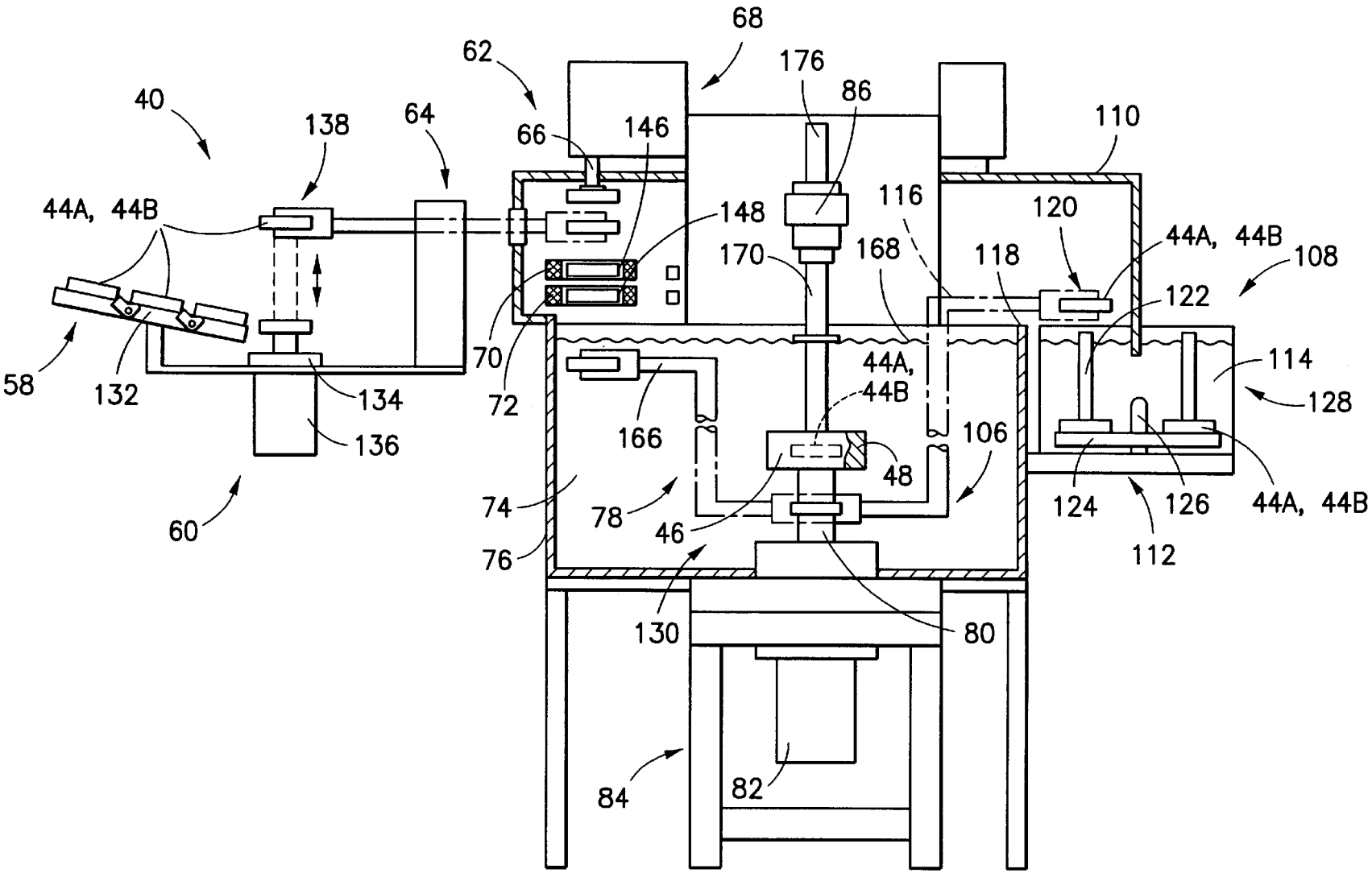
FIG. 4 is a diagrammatic side elevation view of the apparatus illustrated in FIGS. 1 and 2.

Turn now to the drawings, and initially to FIGS. 2–4 which illustrate a preferred embodiment of a system 40 according to the invention devised for net shaping raceways 42A, 42B of high performance rolling element bearing races 44A, 44B (see FIG. 5) by controlled deformation using a fixed axis through-feed of a workpiece and in-feed of two rolling dies 46, 48 on moving axes. Throughout this description, viewing FIG. 5, bearing race 44A and associated raceway 42A refer to the inner race of a rolling element bearing 50 and bearing race 44B and associated raceway 42B refer to the outer race of the same rolling element bearing. Further, for ease of description, throughout this disclosure, the reference numerals for a particular component will remain consistent whether reference is being made to a "blank", to a "workpiece", or to a net shaped or finished item. The stage of the process for the particular item will be understood from the context.

Also, for purposes of the present disclosure, the workpiece 44A, 44B is referred to initially as a "near net shaped bearing race blank" and when all processes of the invention have been completed, it is referred to as a "net shaped bearing race". As a near net shaped bearing race blank, it may have been formed using conventional techniques. As such, for purposes of the invention, the workpiece 44A, 44B is formed with its rolling element engagement surface approximately 0.001 to 0.002 inches oversized in thickness relative to the final or desired size so that the finished race can meet the dimensional tolerances required for high performance rolling element bearings without the necessity of grinding. The displacement of the metal during the deforming operations performed in accordance with the invention serves to remove the excess tooth thickness while assuring the proper profile. Grinding is eliminated, and for this reason alone, there can be as much as a 70% increase in surface durability at any given contact stress level. With continued reference to FIGS. 2–4, a brief overview of the operation of system 40 will be provided, after which a more detailed description of the components of the system 40 will be related. The system 40 provides for the timely and automatic transfer of each workpiece 44A, 44B to a plurality of processing stations.

Figure 5:
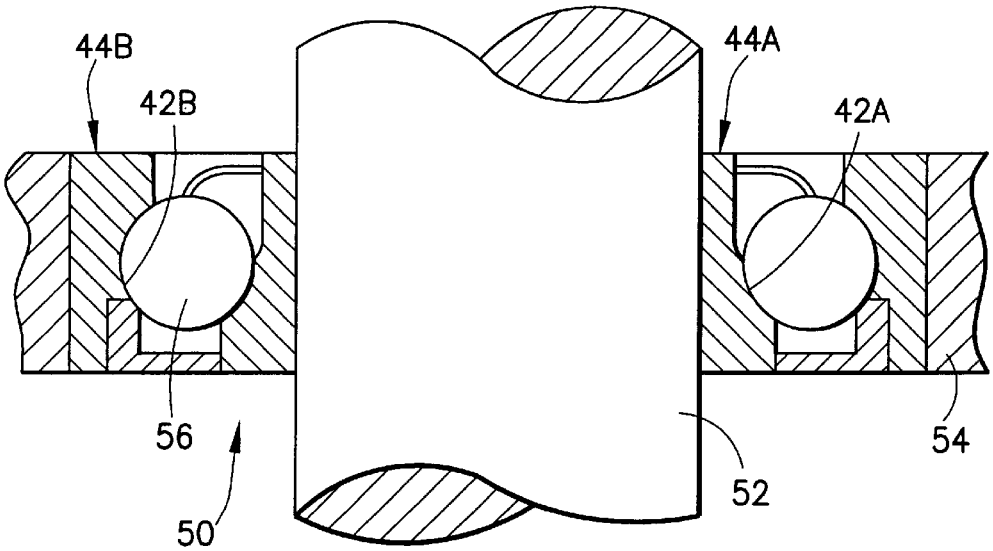
FIG. 5 is a diagrammatic cross section view in elevation of a high performance rolling element bearing of the type being operated on by the technique of the invention.

In a ball bearing as diagrammatically illustrated in FIG. 5 which could also use rollers instead of balls, the inner race 44A typically is mounted with a tight fit on a shaft 52, and the outer race 44B is pressed tightly into the bore of a housing 54. Balls 56, are the anti-friction elements and roll on the raceways 42A, 42B of the inner and the outer races. The raceways 42A, 42B are the load bearing surfaces and are the highly stressed contacting surfaces where the balls or rollers contact the races. These are the surfaces which must have the load carrying capacity, otherwise the bearing 50 will fail by spalling, cracking or plastic flow. The technique of the invention induces additional ausform strengthening to these surfaces. The ausforming effects are localized to the contacting surfaces only where the additional strength is beneficial to improve the performance of the bearings.

At the entrance to the system 40, a workpiece in-chute 58 holds the workpieces 44A, 44B to be processed and, upon command from a suitable process controller (not shown), releases a workpiece to a workpiece loader 60 for subsequent transfer to an induction heating station 62 by means of a swivel robot 64. The heating station 62 includes a support spindle 66 to accept the workpiece from the swivel robot and servo-drives 68 to impart linear and rotary motions to the workpiece. At appropriate times, the support spindle 66 positions the workpiece and drives it at appropriate linear and rotational speeds with respect to MF and RF induction coils 70, 72 respectively, in order for the surface austenitization to be performed then advances it into processing or quench media 74 in a processing tank 76. Contour austenitization of the surfaces of each workpiece is achieved by energizing either or both of the MF and RF induction coils using their respective power supplies (not shown) and for appropriate periods of time. The complete surface austenitization cycle is controlled by a dedicated induction heating process controller (not shown), which in turn is supervised by a software driven process controller (not shown). After the induction austenitization of the surfaces of the workpiece and the rapid quenching thereof to the metastable austenitic condition, a transfer mechanism 78 transfers the workpiece to a through-feed holding spindle 80 for the roll finishing process, as supervised by the process controller.

A through-feed actuator 82 is mounted on a rigid main frame 84 of the system 40 and is connected to the through-feed spindle 80, allowing the workpiece both the translatory and rotary motions required for the rolling action. The processing tank 76 is designed to contain the processing or quench media 74 maintained at a temperature of up to about 600° F. The tank is anchored to the rigid main frame 84 with suitable seals designed to contain the hot media. Housings for the rolling dies and the adjustment mechanisms to align the axes of the rolling dies in the in-plane, out-of-plane and axial direction are all contained in the processing or quench media 74 to maintain the rolling hardware at a thermally stable forming temperature.

The adjustments to the axes of the rolling dies are performed by remotely operated actuators. As seen in FIGS. 2–4, the rolling dies 46, 48 are power driven through constant velocity joints 86 which allow in-feed motion of the rolling dies 46, 48 towards and away from the workpiece 44A, 44B. This arrangement is particularly well seen in FIGS. 2 and 3. Both complete in-feed assemblies 88, 90, including rolling die housings 92 and adjustment mechanisms 94 are guided on precision linear bearing elements 96 which, in turn, are suspended from bridge 98 of the rigid main frame 84. The in-feed forces and motions are provided by the two in-feed actuators 100 mounted on spaced columns 102, 104 of the rigid main frame. The connections between the in-feed actuators 100 and the in-feed assemblies 88, 90 pass through the walls of the processing tank 76, and are properly sealed to prevent drainage of the processing or quench media 74 while allowing the linear in-feed motions.

Throughout the thermo-mechanical processing cycle including surface austenitization, rapid quench to metastable austenitic condition, roll finishing, and the final quench to martensite, an enclosure 110 contains and maintains an inert environment of nitrogen or argon, for example, to protect the workpiece surfaces from oxidation, the recirculating inert gas being continuously monitored for oxygen level, and refurbished as required.

After the roll finishing cycle is completed, a transfer system 106, similar to transfer mechanism 78, then accepts the processed workpiece 44A, 44B and transfers it to an indexing quench station 108 (FIG. 4) for final transformation to martensite. The indexing quench station 108 includes a tank or vessel 112 which contains a thermally controlled liquid working medium 114 which may be similar to the quench media 74 utilized in the processing tank 76. In this instance, the working medium 114 is maintained at a substantially uniform temperature in the range of approximately 50° F. to 250° F. which is broadly considered to be "room temperature". The vessel 112 is so positioned in relation to the rest of the system 40 that the transfer mechanism 106 always remains in the inert atmosphere provided by the enclosure 110. As seen in FIG. 4, a transfer arm 116 of the transfer mechanism is elevated until it overlies an upper rim 118 of the processing tank 76 positioning jaws 120 holding the workpiece 44A, 44B above and in line with a suitable spindle 122 of a workpiece receiving carousel 124. The jaws 120 are then operated to release the workpiece which is, at this stage of the operation, a net shaped race, onto spindle 122. In time, the completed workpiece descends through the working medium 114 until it comes to rest on the carousel 124 or onto a preceding net shaped race. Preferably, the carousel is caused to rotate about a hub 126. This motion causes some measure of agitation of the working medium 114 and also presents the completed workpieces to an exit location 128 outside of the enclosure 110.

The processed workpiece is finally unloaded from the indexing quench station for subsequent operations.

For programmed execution of the process sequence, the process controller, earlier mentioned, operates the various material transfer mechanisms which include modules such as the in-chute 58, workpiece loader 60, swivel robot 64, the transfer mechanisms 78 and 106, respectively, and the indexing quench station 108. Each of these modules performs one or more of the following functions: gripping of the workpiece 44A, 44B, vertical (up/down) translation, rotation, extension and retraction of a gripping arm (to be described). The control of the bearing race finishing machine 130 involves the coordinated operation of the servo-controlled actuators for the through-feed of the workpiece and the in-feed of the two rolling dies, the drive from the prime movers to the rolling dies, and the operation of the workpiece holding chuck on the through-feed spindle 80. The control of the workpiece surface austenitization process involves the operation of the servo-controlled drives 68 of the heating station 62, and the energizing/deenergizing of the MF/RF power at induction coils 70, 72 supplied in a programmed sequence. The power supplies have built-in dedicated power levels and on-time controllers for precise monitoring and control of the induction heating process.

Returning to FIG. 4, it is seen that a plurality of workpieces 44A, 44B are advanced toward the system 40 by means of the in-chute mechanism 48 which includes an elongated magazine 132. The workpieces 44A, 44B are advanced along the magazine 132 to a platform 134 of the workpiece loader 60. With the workpiece 44A, 44B properly positioned on the platform 134, an actuator 136 is effective to raise the platform 134 with the workpiece 44A, 44*b* thereon from a lowered position to a raised position.

When the platform 134 reaches the raised position, as illustrated in FIG. 4, the workpiece 44A, 44B assumes the same elevation of that of a transfer arm 138 of the swivel robot 64 which is able to pivot through at least 180°. That is, it can move from a solid line position such that workpiece engaging finger members are generally aligned with the platform 134 of the workpiece loader 60 to a dashed line position generally aligned with associated components of the heating station 62. The transfer arm 138 is then swung from the solid line, or pick-up, position to a delivery or dashed line position generally aligned with the induction coils 70, 72 at the heating station 62. It will be appreciated that as the transfer arm 138 is swung from the workpiece loader 60 to the heating station 62, it passes through an opening 140 in a wall of the enclosure 110. The opening 140 is of a suitable construction to allow passage of the transfer arm 138 while retaining the inert environment provided by the enclosure.

When the transfer arm 138 is moved to the dashed line position illustrated in FIG. 4, the upper actuator mechanism 68 is operable to withdraw the support spindle 66 to an initial fully retracted position as indicated by solid lines. A terminal end of the support spindle 66 may have, for example, a pneumatically operated expandable chuck capable of retracting to gain entry into an inner cylindrical surface 150 of the workpiece 44A or with the raceway 42B of the workpiece 44B, then be caused to expand into engagement therewith. Thus, when the transfer arm 138 has been moved to the dashed line position indicated in FIG. 4, the upper actuator mechanism 68 can be operated to advance the support spindle 66 until the expandable chuck is positioned so as to be generally coextensive with the inner cylindrical surface or raceway of the workpiece 44A, 44B. The chuck is then expanded so as to engage the workpiece and the finger members of the transfer arm 138 are caused to release their engagement with the outer peripheral surfaces of the workpiece. Again, the support spindle 66 is caused to be raised and, with it, the workpiece 44A, 44B. With the workpiece now out of alignment with the transfer arm 138, the latter is returned to its solid line position (FIG. 4) and in position to receive a subsequent workpiece at the workpiece loader 60. Induction coils 70 and 72 are suitably mounted on the frame 84 in a manner not illustrated. Viewing FIG. 4, the induction coil 70 defines a first heating zone 146 and the induction coil 72 defines a second heating zone 148. A suitable source of electrical energy serves to energize the first induction heater at a medium frequency (MF) in the range of 2–20 Khz which is effective to impart adequate heat to the first heating zone 146 to thereby heat the workpiece 44A, 44B to a predetermined surface temperature and to a predetermined thermal gradient through the carburized case of the workpiece. Thus, the heat provided by the induction coil 70 is such as to heat the carburized case of the workpiece to a desired surface temperature and the sub case regions to a desired thermal gradient therethrough. The source for energizing the induction coil 72 and thereby heating the second heating zone 148 is operable at a radio frequency (RF) in the range of 100–450 Khz which is effective to impart adequate heat to the second heating zone 148 to thereby heat the carburized case of the workpiece 44A, 44B above its critical temperature to maintain the austenitic structure in the carburized case of the workpiece. In this instance, the frequency used is effective to austenitize the carburized case.

The upper actuator mechanism 68 is thus selectively operable to move the support spindle 66 from a fully withdrawn position within the rotary actuator mechanism 68 to a first position capable of receiving a workpiece 44A, 44B from the transfer arm 138 then to a second advanced position aligned within the first heating zone 146, and then to a third advanced position aligned within the second heating zone 148.

When the workpiece 44A, 44B supported on the support spindle 66 is positioned within the first heating zone 146, the upper actuator mechanism 68 is operated to rotate the support spindle 66 on its longitudinal axis and, thereby the workpiece 44A, 44B. The induction coil 70 is simultaneously energized by an electrical source which is provided at a frequency effective, as mentioned above, to impart adequate heat to the heating zone 146 to thereby heat the workpiece to a predetermined surface temperature and to a predetermined thermal gradient through the carburized case of the workpiece. After a predetermined time, the rotary actuator mechanism operates to stop rotation of the support spindle 66 and the upper actuator mechanism 68 is operated to advance the workpiece 44A, 44B to a second heating zone 148 within the induction coil 72. Again, the rotary actuator mechanism is effective to rotate the support spindle 66 on its longitudinal axis and, thereby, the workpiece 44A, 44B at a predetermined rotational speed. As in the instance of the induction coil 70, the induction coil 72 is then energized at a frequency effective to impart adequate heat to the second heating zone 148 to thereby heat the carburized case of the workpiece 44A, 44B above its critical temperature to maintain the austenitic structure throughout its carburized case.

As heating proceeds within each of the induction coils 70, 72, the temperature of the workpiece may be monitored by means of a suitable temperature sensor.

Figure 6:
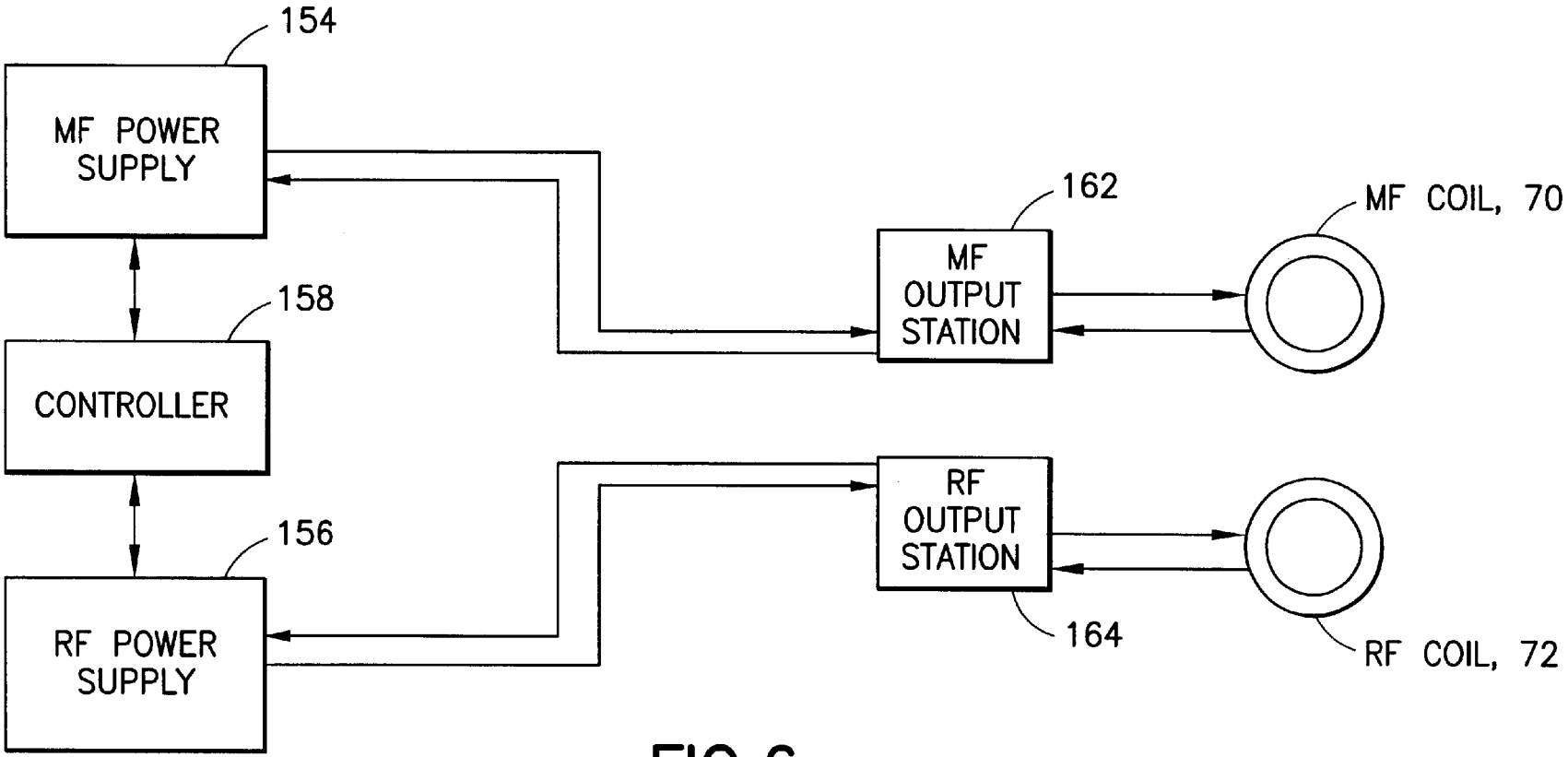
FIG. 6 is a schematic diagram of an induction heating system for use with the invention.
Figure 7:
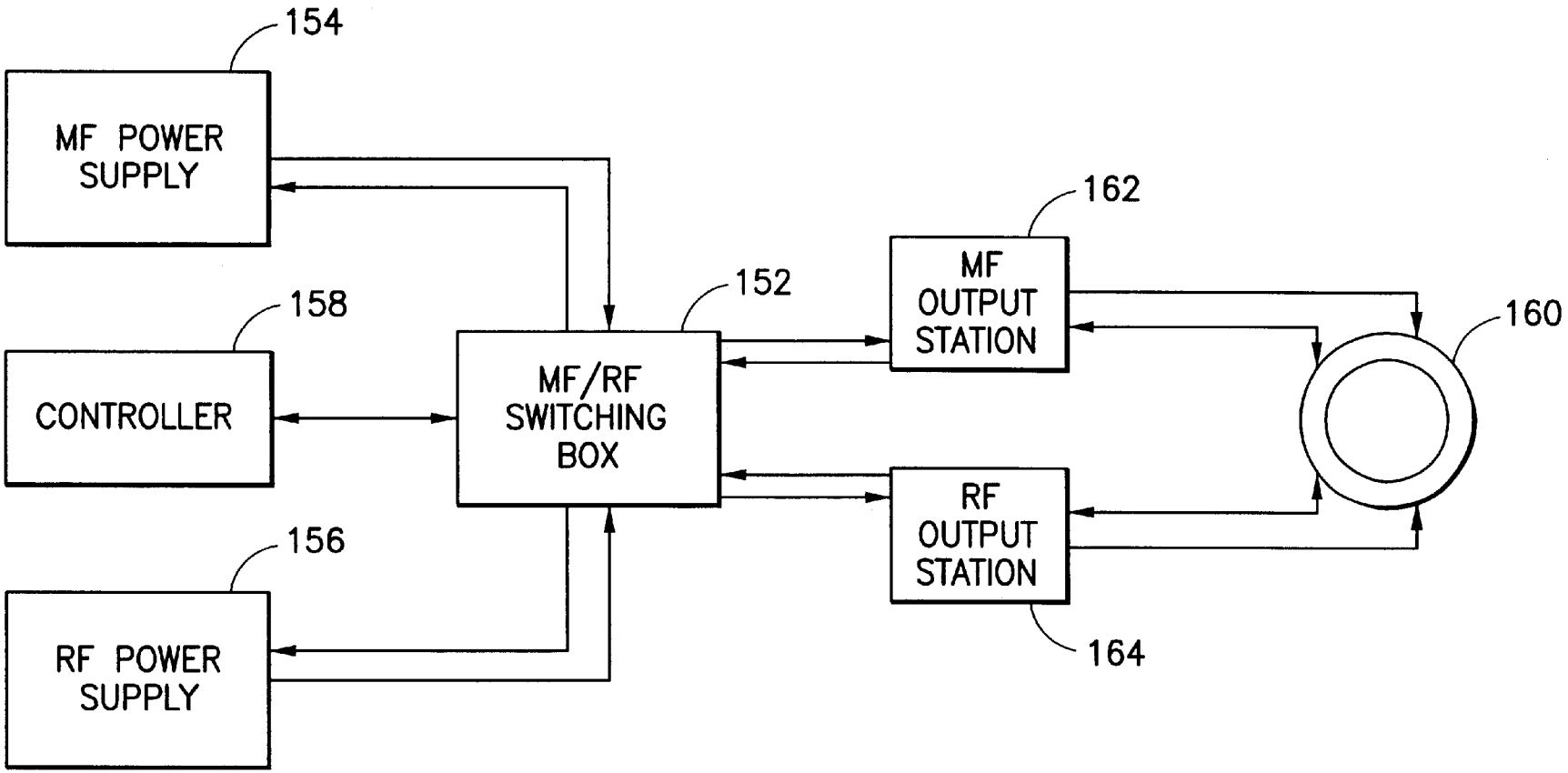
FIG. 7 is a schematic diagram of another embodiment of an induction heating system for use with the invention.

The heating operation may be more clearly understood with the aid of FIGS. 6 and 7, FIG. 6 being representative of the heating station illustrated in FIG. 4. Such an arrangement is acceptable so long as the workpiece 44A, 44B is cylindrically shaped. However, for tapered rolling element bearings having the construction as illustrated in FIG. 5, the part geometry does not allow for efficient axial traverse of the workpiece from the MF coil 70 to the RF coil 72 as would be required. One possible solution would be to make the annular hole of the coils in FIG. 6 be much larger to allow passage of the workpiece. Another way would be to use a coil as shown, but then move the workpiece out, and then relocate the MF coil elsewhere and bring the RF coil into position. Both of these solutions would be inefficient, however, and may not be feasible from the metallurgical standpoint.

Accordingly, as schematically indicated in FIG. 7, it is proposed to use a switching box 152 where MF and RF power supplies 154, 156, respectively, under the guidance of a controller 158 are connected in such a way as to power a single induction coil 160 from the MF power supply first through an MF output station 162, then turn it off, switch the connections to the RF side, turning on the RF power supply so as to power the induction coil 160 through an RF output station 164, and so on to complete the process. Such an arrangement would greatly simplify the structure of the system 40.

Upon the conclusion of operations at the heating station 62 as just described, the upper actuator mechanism 68 then rapidly advances the support spindle 66 and the workpiece 44A, 44B it is holding beyond the coils 70, 72 and into the quench media 74 contained within the processing tank or vessel 76. The quench media 74 may be a commercially available marquenching oil which is thermally controlled to maintain the workpiece at a uniform metastable austenitic temperature just above the martensitic transformation temperature. The workpiece 44A, 44B remains submerged in the quench media 74 for the duration of all net shaped forming operations, as will be described.

The workpiece transfer mechanism 78 includes a transfer arm 166 generally similar in construction and operation to transfer arm 138. Transfer arm 166 is vertically movable between a raised, solid line, position indicated in FIG. 4 and a lowered, dashed line, position indicated in the same figure. In the raised position, the transfer arm 166 is positioned to receive a workpiece 44A, 44B from the support spindle 66 immediately after the workpiece has been deposited in the quench media 74 from the heating station 62.

Thus, when the support spindle 66 is in its fully extended condition holding the workpiece 44A, 44B submerged in the quench media 74 just beneath an upper surface 168 thereof (FIG. 4), the transfer arm 166 is raised to the level of the workpiece while holding opposed jaws thereon in an open position generally encircling the workpiece but not engaging it. Thereupon, a suitable jaw actuator is operable for firm engagement with the workpiece. Thereupon the chuck associated with the support spindle 66 holding it just beneath the upper surface 166 of the quench media 74 is deflated and the support spindle 66 withdraws, being elevated away from the region of the workpiece. Thereupon, the transfer mechanism 78 is operated to cause the transfer arm 166 to descend from the raised, solid line position to the lowered dashed line position.

When the transfer mechanism is in the lowered position, the transfer arm 166 lies generally in a plane for the reception of the workpiece by the through-feed spindle 80.

The through-feed spindle 80 is of a construction similar to spindle 66 in that it has an expandable chuck which is engageable with the inner surface of a workpiece 44A, 44B. Thus, when the jaws of the transfer arm 166 have moved to a position such that the workpiece overlies the through-feed spindle 80, operation of the through-feed actuator 82 causes elevation of the spindle 80 and its associated chuck until the chuck enters and engages the workpiece. Thereupon, the jaws are opened, the actuator 82 is operated to temporarily lower the workpiece out of the plane of the transfer arm 166, and the latter is swung once again back to the solid line position of FIG. 4. The through-feed actuator 82 then operates to elevate the workpiece 44A, 44B into a generally coextensive or coplanar relationship with the rolling dies 46, 48.

Figure 8:
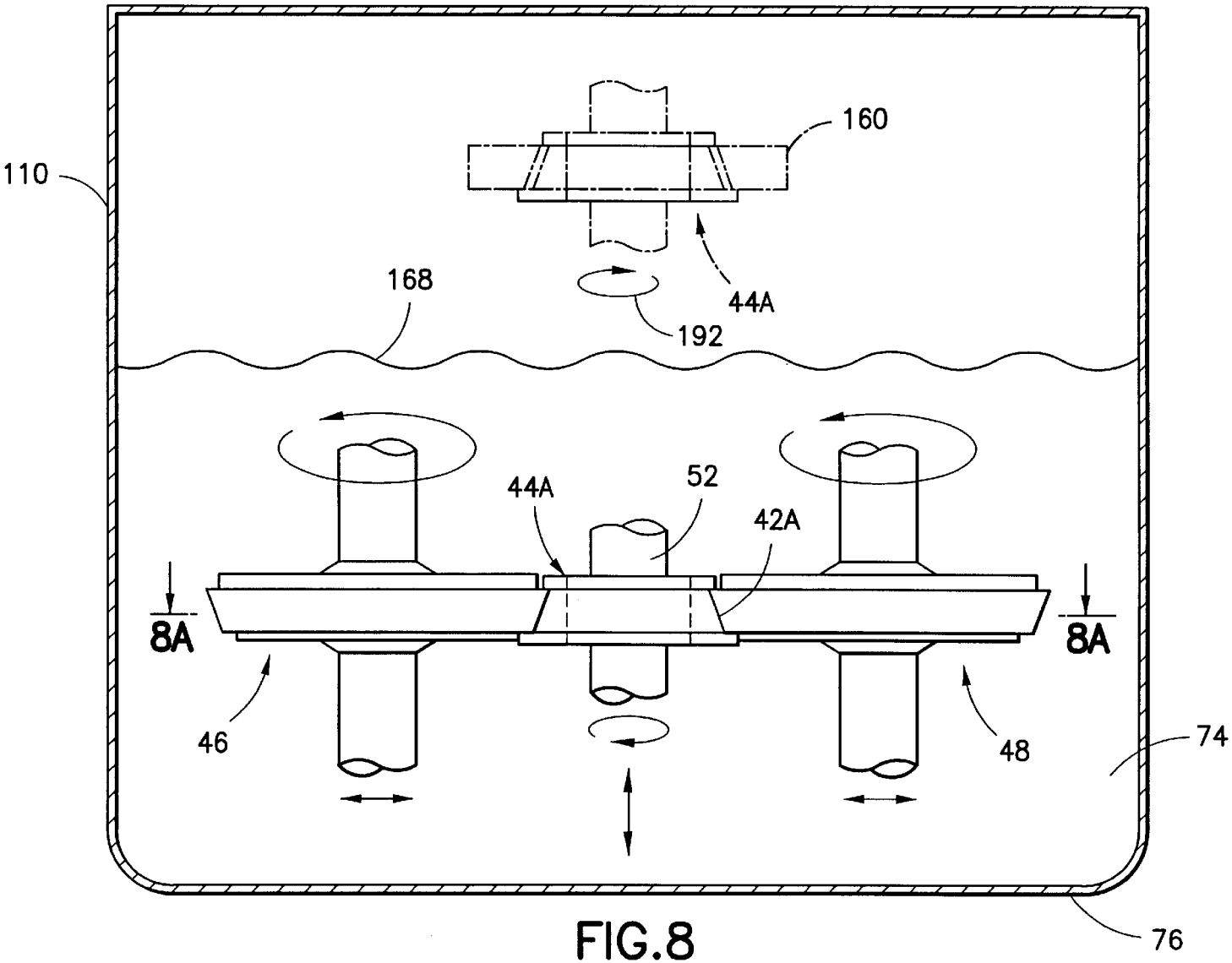
FIG. 8 is a diagrammatic side elevation view of a thermo-mechanical roll finishing operation, in accordance with the invention, being performed on the raceway of an inner race of a high performance rolling element bearing.
Figure 9A:
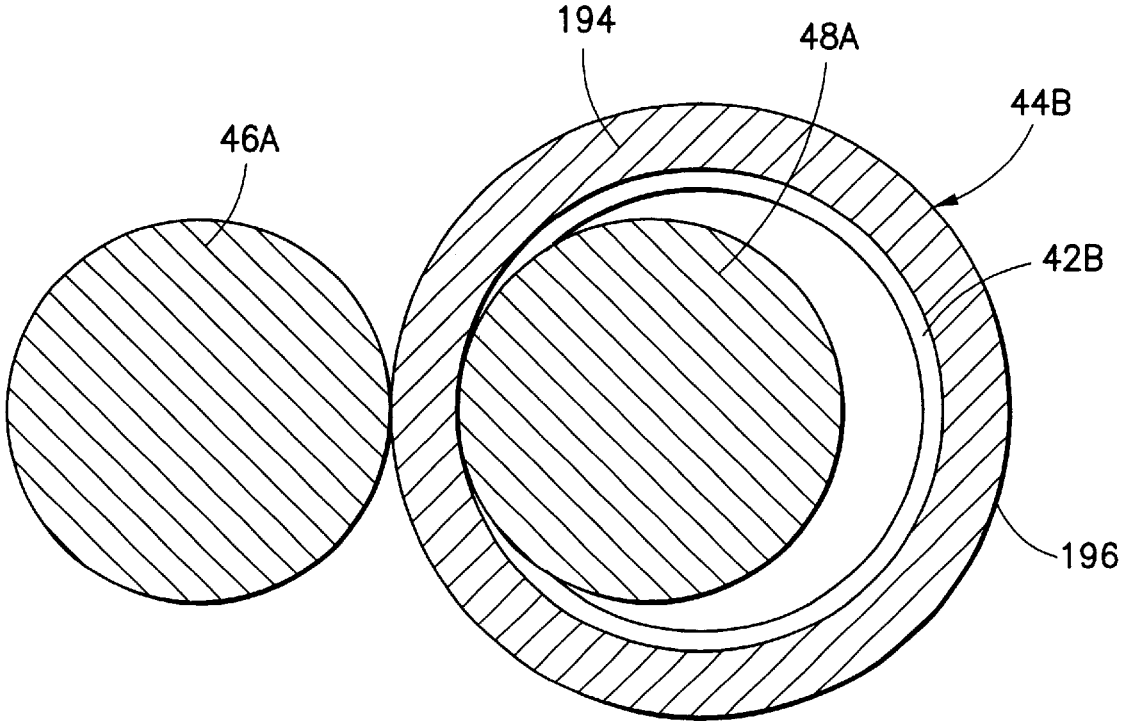
FIG. 9A is a cross section view taken generally along line 9A—9A in FIG. 9.
Figure 9:
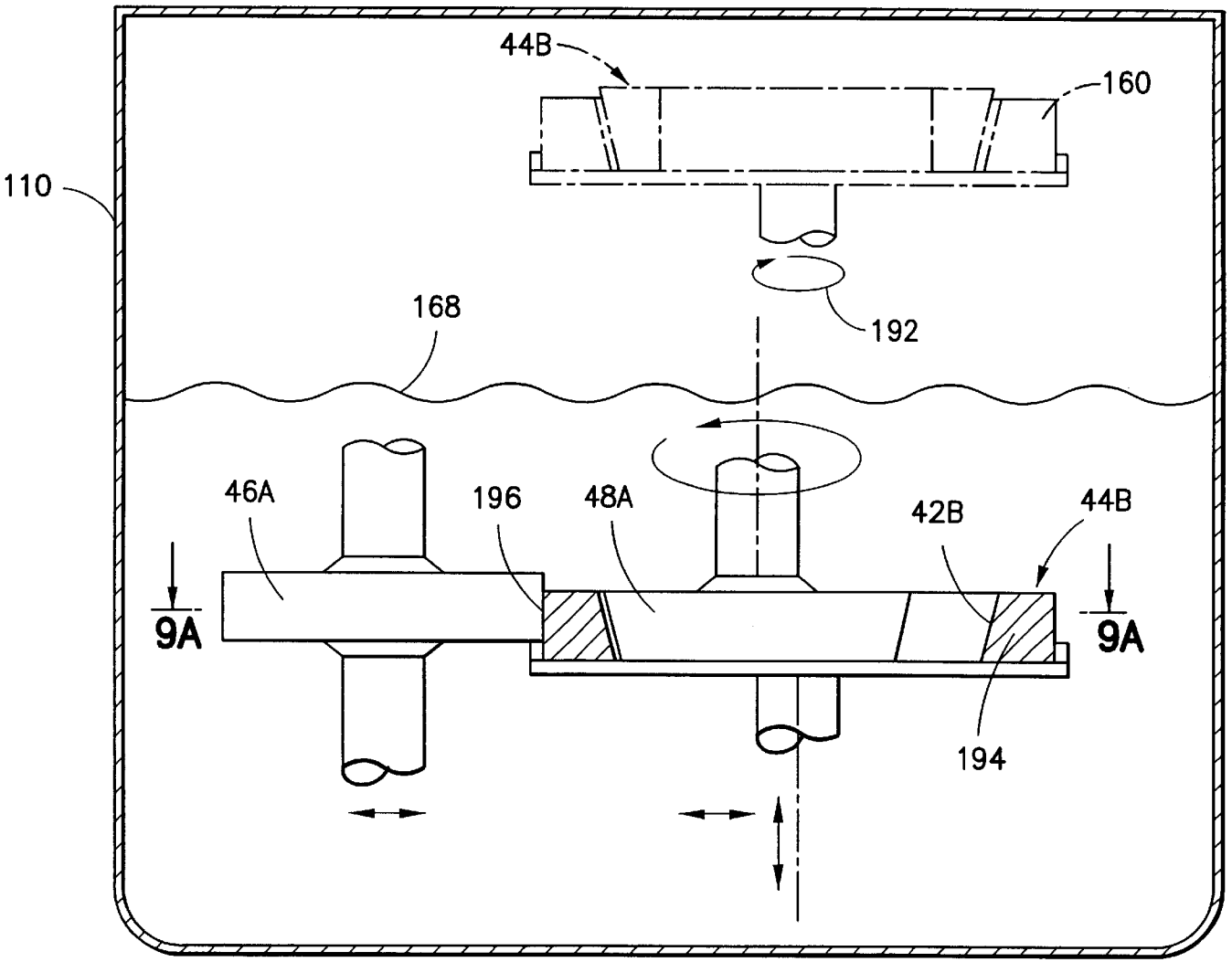
FIG. 9 is a diagrammatic side elevation view of a thermo-mechanical roll finishing operation, in accordance with the invention, being performed on the raceway of an outer race of a high performance rolling element bearing.
Figure 11:
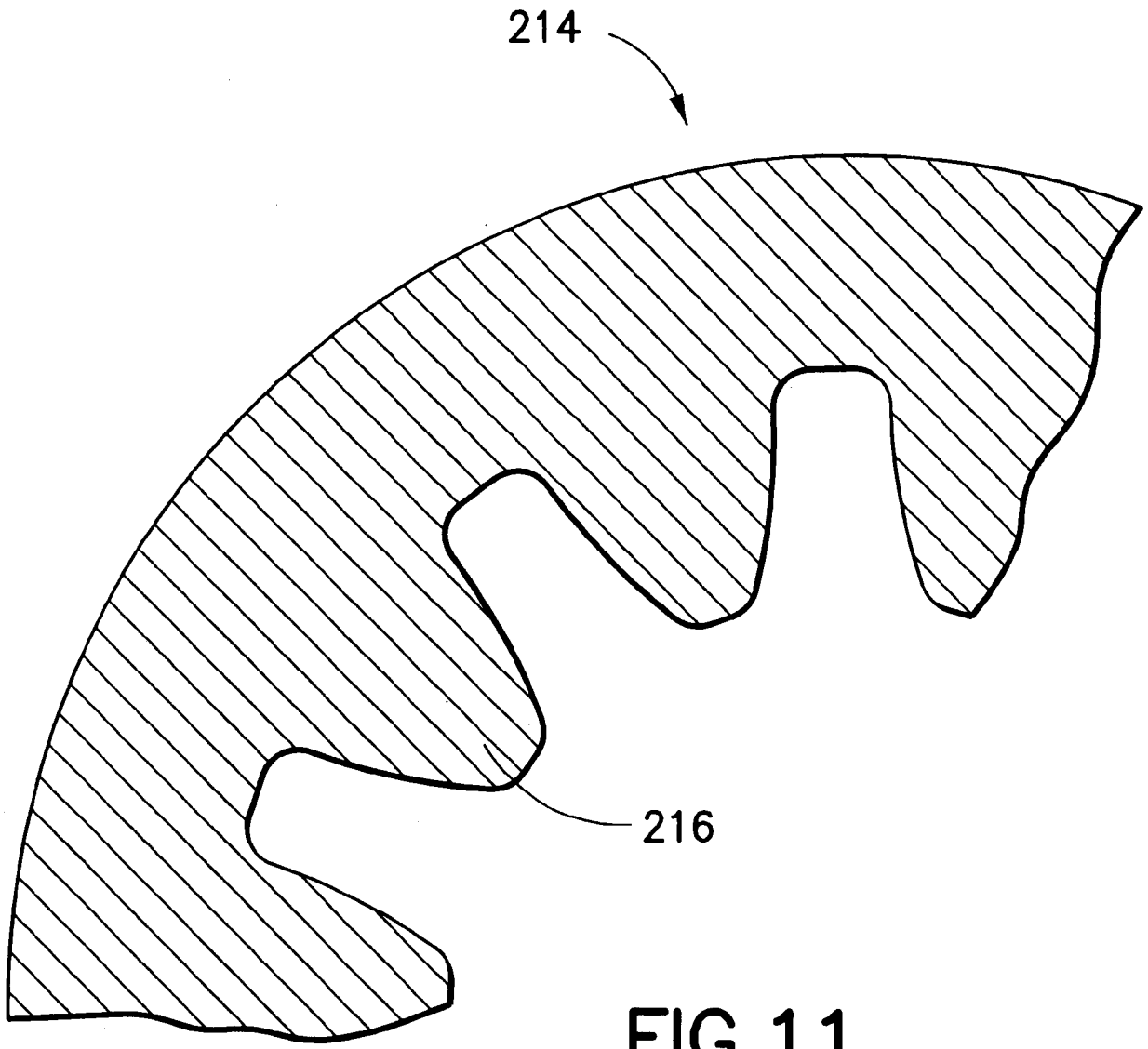
FIG. 11 is a detail plan view of a portion of a ring gear having net shaped internal gear teeth formed according to the invention.

As mentioned earlier, the system 40 includes a pair of opposed in-feed assemblies 78, 80 which are substantially similar in construction but positioned on diametrically opposite sides of the workpiece 44A, 44B when the latter is in the rolling positions as illustrated in FIGS. 8 and 9. Each in-feed assembly 78, 80 includes a rolling die housing 92 for rotatably supporting on a drive shaft 170 a rolling die, 46, 48, respectively, each of which has an outer peripheral profiled surface for rolling the engagement surfaces of the workpiece 44A, 44B to a desired outer peripheral profiled shape. Of course, as previously noted, this is achieved while holding the temperature of the workpiece in a uniform metastable austenitic temperature range. It was also previously mentioned that the workpiece 44A, 44B has previously been formed as a near net shaped bearing race blank with oversized engagement surfaces. During the operations about to be described, the excess thickness of the engagement surfaces is removed and the proper, or desired, raceway profile achieved.

A rotary drive actuator 172 (see FIGS. 2 and 3) operates the drive shafts 170 for both of the rolling dies 46, 48 in a synchronous manner through a coupling transmission 174, connecting shafts 176, and constant velocity joints 86. It will be appreciated that the longitudinal axes of the through-feed spindle 80 and the axes of rolling dies 46, 48 are nominally parallel. However, this relationship may be altered by reason of the adjustment mechanisms 94 in order to achieve a properly profiled gear from the workpiece 44A, 44B.

It was earlier mentioned that the degree of deformation of the engagement surfaces of the workpiece 44A, 44B must be controlled to very close tolerances by precise monitoring and control of the movements of each of the two rolling dies 46, 48 with respect to the workpiece. It was further mentioned that the workpiece axis as well as the axes of the two rolling dies must be precisely aligned to achieve the high lead and profile accuracy specified for ultra-high precision rolling element bearing races. The adjustment mechanisms 94 which have been broadly mentioned previously provide the adjustments for the rolling dies 46, 48 which are necessary to achieve the high dimensional accuracy being sought.

It was earlier mentioned that the spindle 80 carrying the workpiece 44A, 44B is elevated, that is, moved in a through-feed direction, into an operating position which is generally coextensive with the opposed rolling gear dies 46, 48. Thereafter, the rolling dies 46 and 48 are each simultaneously advanced in an in-feed direction within a common plane which generally contains the axes of the spindle 80 and of both drive shafts 170. The rolling dies 46, 48 advance, respectively, in opposite in-feed directions which are substantially perpendicular to the axis of the workpiece at diametrically opposed locations and at near net shaped center distances which establish initial center distances between the longitudinal axis of each drive shaft 170 and of the spindle 80. The assemblies 88, 90 continue to advance their associated rolling dies 46, 48, respectively, in the in-feed direction each by an additional increment of center distance thereby deforming the engagement surfaces of each workpiece and resulting in a finished net shaped bearing race.

The individual components for each of the in-feed assemblies 88, 90 are substantially similar. Therefore, the description will be substantially limited to in-feed assembly 88, but it will be understood that such description also pertains to in-feed assembly 90, unless otherwise noted. A trolley 178 (FIGS. 2 and 3) is laterally movable on the bearing elements 180 as generally indicated by a double arrowhead 182. In turn, an in-feed assembly frame 184 is fixed to the trolley 178 and depends therefrom. A support block 186 is mounted on the in-feed assembly frame 184. Finally, the bifurcated rolling die housing 92 is mounted on the support block 186 via the adjustment mechanisms 94. The adjustment mechanisms 94 provide for a different types of movement of the rolling die 46 with respect to the workpiece 44A, 44B as indicated by double arrowheads 188, 190. Such movement is effective to adjust the rolling gear die 46 out of a common plane nominally defined by the axes of the drive shafts 170 and of the through-feed spindle 80, or within a common plane containing the longitudinal axes of the drive shaft 170 and of the through-feed spindle 80, or movable along its own axis of rotation relative to the workpiece 44A, 44B.

Figure 8A:
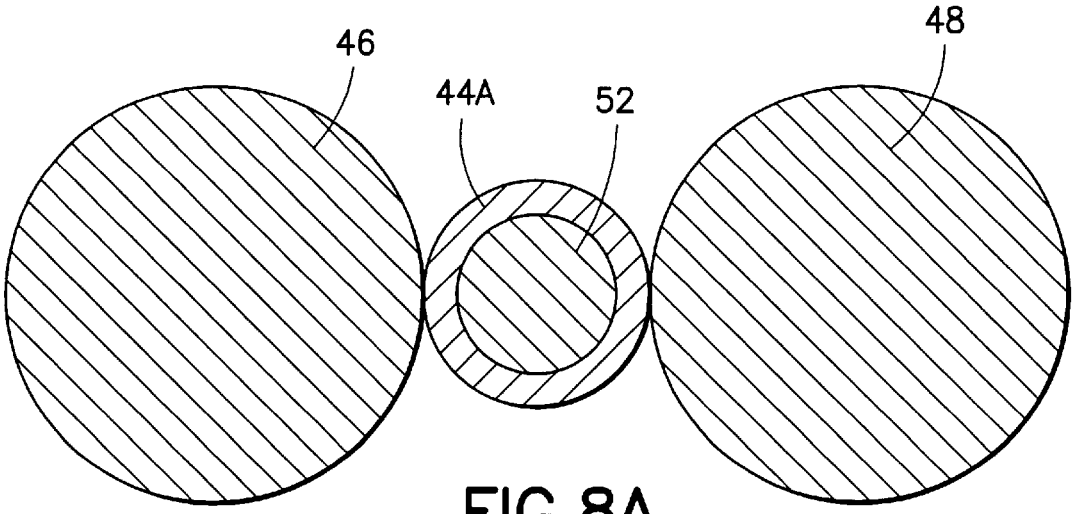
FIG. 8A is a cross section view taken generally along line 8A—8A in FIG. 8.

Turn now to FIGS. 2, 8, and 8A for a description of net shaping an engagement surface or raceway 42A of the inner race blank 44A. The raceway is a peripheral profiled rolling element engagement surface with a hardened case in the metastable austenitic condition and slightly oversized from that of a desired formed engagement surface. In FIG. 8, the workpiece 44A is illustrated by dashed lines being heated in the induction coil 160, although it might just as properly be within the induction coils 70, 72 in the proper sequence, rotation of the workpiece being indicated by an arrowhead 192. After completion of the proper heating cycle, the workpiece 44A is immersed in the quench media 74 to a depth so as to be substantially coextensive with the first and second rolling dies 46, 48 in the through feed direction. At this stage, the rolling dies 46, 48 are sufficiently separated to freely allow entry of the workpiece.

When the workpiece is properly positioned, the rolling dies 46, 48 which are actually finishing dies are advanced until their outer peripheral surfaces respectively engage the workpiece at diametrically opposed locations (FIG. 8A) and at near net shaped center distances establishing initial center distances between the axes of rotation of the rolling dies and of the workpiece, respectively, when the workpiece and the rolling dies are initially engaged. Thereafter, the rolling dies continue to advance in the in-feed direction by an additional increment of center distance thereby deforming the peripheral profiled engagement surface of the bearing race blank 44A, resulting in a final net shape of the rolling element engagement surface or raceway 42A.

Turn now to FIGS. 3, 9, and 9A for a description of net shaping an engagement surface or raceway 42B of the outer race blank 44B. As with the inner race blank 44A, the raceway 42B of the outer race blank 44B is a peripheral profiled rolling element engagement surface with a hardened case in the metastable austenitic condition. In this instance, however, the outer race blank includes a ring-shaped member 194 having an outer peripheral surface 196 and an inner raceway 42B which is a contoured roller element engagement surface slightly oversized from that of a desired formed engagement surface. Also, similar to the inner race blank 44A, the workpiece 44B is illustrated by dashed lines being heated in the induction coil 160, although it might just as properly be within the induction coils 70, 72 in the proper sequence, rotation of the workpiece being indicated by the arrowhead 192. After completion of the proper heating cycle, the workpiece 44B is immersed in the quench media 74 to a depth so as to be substantially coextensive with the first and second rolling dies 46A, 48A in the through feed direction. The rolling dies for the outer race blank 44B are somewhat modified from those employed for the inner race blank 44A, as will be noted below. One of the die housings, indicated by reference numeral 92A is also somewhat modified and necessarily has an axis somewhat offset laterally from its mating die housing 92 used for operations on the inner race 44A. In any event, at this stage, the rolling dies 46A, 48A are sufficiently separated to freely allow entry of the workpiece 44B.

When the workpiece 44B is properly positioned, the rolling dies 46A, 48A are advanced until their outer peripheral surfaces respectively engage the ring shaped member 194 at opposed locations (FIG. 9A) and at near net shaped center distances establishing initial center distances between the axes of rotation of the rolling dies and of the workpiece, respectively, when the workpiece and the rolling dies are initially engaged. In this instance, the rolling die 46A moves only until such time that its outer peripheral surface tangentially engages the outer peripheral surface 196 of the workpiece 44B, then stops, to provide a support for the operation to be performed by the rolling die 48A. Indeed, the rolling die 48A, which is a finishing die, continues to advance in the in-feed direction by an additional increment of center distance thereby deforming the peripheral profiled engagement surface 42B of the bearing race blank 44A, resulting in a final net shape of the rolling element engagement surface or raceway 42B.

Figure 10A:
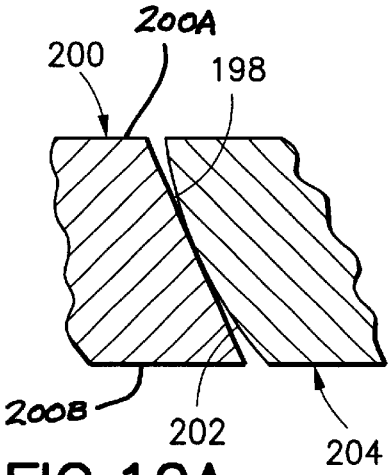
FIG. 10A is a detail cross section view illustrating one preferred contacting pattern between the raceway and the rolling elements of a high performance rolling element bearing produced according to the invention.
Figure 10B:
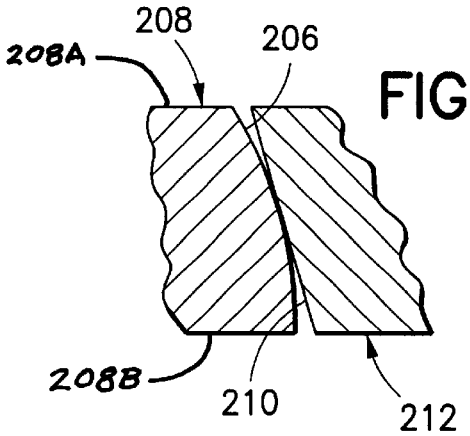
FIG. 10B is a detail cross section view illustrating another preferred contacting pattern between the raceway and the rolling elements of a high performance rolling element bearing produced according to the invention.

Further, according to the invention, FIGS. 10A and 10B are detail cross section views illustrating preferred contacting patterns between the raceway and the rolling elements of a high performance rolling element bearing produced according to the invention. More specifically, the bearing races and/or rolling elements are designed such that as the load increases, the contacting pattern between the rolling elements and the raceways spreads evenly from the middle towards the ends. In order to achieve this, either the raceways or the rollers are crowned, i.e. have a slightly raised and curved contour. In FIG. 10A, a raceway 198 of race 200 between spaced lateral surfaces 200A and 200B is indicated as being flat while an engaging surface 202 of a rolling element 204 is indicated as being crowned. Oppositely, in FIG. 10B, a raceway 206 of race 208 between spaced lateral surfaces 208A and 208B is indicated as being crowned while an engaging surface 210 of a rolling element 212 is indicated as being crowned. In this manner, as the load increases, the resulting deformations spread the contact area and the loads. The rolling dies must be designed to produce this specially contoured contacting surfaces of the bearing raceways. The design must allow for the above, as well as for material flow and elastic deformations. Once the dies have been developed to achieve the precise finished geometry, a very large number of repeatable and accurate raceways can be produced. On the other hand, grinding wheels wear away and therefore must be periodically dressed to correct the contoured form.

Although the present invention has been described with reference to the embodiments shown in the drawings, it should be understood that the present invention can be embodied in many alternate forms of embodiments. In addition, any suitable size, shape or type of elements or materials could be used. Thus, while preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A method of net shaping raceways of high performance rolling element bearing races comprising the steps of:

(a) heating a workpiece in the form of a near net shaped bearing race blank having a rolling element engagement surface with a case above its critical temperature to obtain an austenitic structure throughout its hardened case. the engagement surface intended for engagement by a plurality of rolling elements;

(b) quenching the workpiece at a rate greater than the critical cooling rate of its case to a uniform metastable austenitic temperature above the martensitic transformation temperature;

(c) holding the temperature of the workpiece at the uniform temperature while crowning the engagement surfaces of the workpiece between spaced lateral surfaces and maintaining the engaging surfaces of rolling dies flat or crowning the engaging surfaces of the rolling dies and maintaining the engagement surfaces of the workpiece flat, then rolling the engagement surface between a pair of the opposed rolling dies to a desired shape before martensitic transformation occurs; and (d) cooling the workpiece through the martensitic range to harden the engagement surface.

2. A method as set forth in claim 1 wherein step (c) includes the step of:

e) rapidly transferring the bearing race blank to a thermally controlled liquid working medium; and (f) submerging the bearing race blank in the liquid working medium for the performance of step (c).

3. A method as set forth in claim 1 wherein steps (b) and (c) are performed in a first quench medium maintained at a temperature up to approximately 600° F.

4. A method as set forth in claim 1 wherein the engagement surface of each bearing race blank is oversized compared to the desired final size of the engagement surface of the net shaped bearing race; and wherein at least one of the rolling dies has an outer peripheral profiled surface which is substantially similar to that of the desired shape.

5. A method as set forth in claim 1

(e) quenching the workpiece to the martensitic structure in a second quench medium maintained at a temperature in the range of approximately 50° F. to 250° F.

6. A method as set forth in claim 1 wherein step (b) includes the steps of:

(e) providing a first toroidal shaped induction heater defining a first heating zone;

(f) supporting the workpiece within the first heating zone so as to be coaxial with the first induction heater;

(g) rotating the workpiece on its axis of rotation within the first heating zone at a first rotational speed;

(h) energizing the first induction heater at a frequency effective to impart adequate heat to the first heating zone to thereby heat the workpiece to an elevated surface temperature resulting in a desired thermal gradient at least through the engagement surface of the workpiece;

(i) providing a second toroidal shaped induction heater defining a second heating zone;

(j) upon completion of step (h), rapidly transferring the workpiece from the first induction heater to the second induction heater;

(k) supporting the workpiece within the second heating zone so as to be coaxial with the second induction heater;

(l) rotating the workpiece on its axis of rotation within the second heating zone at a second rotational speed; and (m) after a time delay from the conclusion of step (h), energizing the second induction heater at a frequency effective to impart adequate heat to the second heating zone to thereby heat the engagement surface of the workpiece above its critical temperature to obtain the austenitic structure.

7. A method as set forth in claim 1 wherein step (b) includes the steps of:

(e) providing a toroidal shaped induction heater defining a heating zone;

(f) supporting the workpiece within the heating zone so as to be coaxial with the induction heater;

(g) rotating the workpiece on its axis of rotation within the heating zone at a first rotational speed;

(h) energizing the induction heater at a first frequency effective to impart adequate heat to the heating zone to thereby heat the workpiece to an elevated surface temperature resulting in a thermal gradient at least through the engagement surface of the workpiece;

(i) upon completion of step (i), rotating the workpiece on its axis of rotation within the heating zone at a second rotational speed; and (j) after a time delay from the conclusion of step (i), energizing the induction heater at a second frequency effective to impart adequate heat to the heating zone to thereby heat the engagement surface of the workpiece above its critical temperature to obtain the austenitic structure.

8. A method as set forth in claim 7 wherein step (h) is performed at a frequency in the range of approximately 2 to 20 kHz; and wherein step (j) is performed at a frequency in the range of approximately 100 to 450 kHz.

9. A method as set forth in claim 1 including the step of:

(e) providing an inert atmosphere during the performance of all steps therein.

10. A method of net shaping raceways of rolling element bearing races of high performance rolling element bearings comprising the steps of:

(a) rotatably supporting on its axis a workpiece in the form of a near net shaped race blank having a rolling element engagement surface;

(b) while rotating the workpiece, heating it within an inert atmosphere above its critical temperature in a toroidal shaped induction heater for a sufficient time to obtain an austenitic structure throughout its hardened case;

(c) rapidly stopping rotation of the workpiece;

(d) rapidly withdrawing the workpiece from the induction heater after the sufficient time and, in a continuing movement, rapidly quenching the workpiece at a rate greater than the critical cooling rate of its case to a uniform metastable austenitic temperature above the martensitic transformation temperature, (e) holding the temperature of the workpiece at the uniform temperature while crowning the engagement surfaces of the workpiece between spaced lateral surfaces and maintaining the engaging surfaces of rolling dies flat or crowning the engaging surfaces of the rolling dies and maintaining the engagement surfaces of the workpiece flat, then (f) rolling the engagement surface between a pair of opposed rolling finishing dies to a desired shape before martensitic transformation occurs; and (g) cooling the workpiece through the martensitic range to harden the engagement surface.

11. A method of net shaping inner and outer races of high performance rolling element bearings as set forth in claim 10 wherein step (b) includes steps of:

(h) providing a first toroidal shaped induction heater defining a first heating zone;

(i) supporting the workpiece within the first heating zone so as to be coaxial with the first induction heater;

(j) rotating the workpiece on its axis of rotation within the first heating zone at a first rotational speed;

(k) energizing the first induction heater at a frequency effective to impart adequate heat to the first heating zone to thereby heat the workpiece to an elevated surface temperature resulting in a thermal gradient at least through the case surfaces of the workpiece;

(l) providing a second toroidal shaped induction heater defining a second heating zone;

(m) upon completion of step (l), rapidly transferring the workpiece from the first induction heater to the second induction heater;

(n) supporting the workpiece within the second heating zone so as to be coaxial with the second induction heater;

(o) rotating the workpiece on its axis of rotation within the second heating zone at a second rotational speed; and (p) after a time delay from the conclusion of step (l), energizing the second induction heater at a frequency effective to impart adequate heat to the second heating zone to thereby heat the case surfaces of the workpiece above its critical temperature to obtain the austenitic structure.

12. A method of net shaping inner and outer races of high performance rolling element bearings as set forth in claim 11 wherein the first induction heater includes an MF induction heater coil whose electric field is operable in the range of approximately 2 to 20 kHz; and wherein the second induction heater includes an RF induction heater coil whose electric field is operable in the range of approximately 100 to 450 kHz.

13. A method of net shaping inner and outer races of high performance rolling element bearings as set forth in claim 10 wherein step (a) includes the steps of:

(h) providing a toroidal shaped induction heater defining a heating zone;

(i) supporting the workpiece within the heating zone so as to be coaxial with the induction heater;

(j) rotating the workpiece on its axis of rotation within the heating zone at a first rotational speed;

(k) energizing the induction heater at a first frequency effective to impart adequate heat to the heating zone to thereby heat the workpiece to an elevated surface temperature resulting in a thermal gradient through the case of the engagement surface of the workpiece;

(l) upon completion of step (j), rotating the workpiece on its axis of rotation within the heating zone at a second rotational speed; and (m) after a time delay from the conclusion of step (j), energizing the induction heater at a second frequency effective to impart adequate heat to the heating zone to thereby heat the engagement surface of the workpiece above its critical temperature to obtain the austenitic structure.

14. A method of net shaping inner and outer races of high performance rolling element bearings as set forth in claim 13 wherein the induction heater includes:

an MF induction heater coil whose electric field is operable in the range of approximately 2 to 20 kHz; and an RF induction heater coil whose electric field is operable in the range of approximately 100 to 450 kHz.

15. A method as set forth in claim 10 including the step of:

(h) providing an inert atmosphere during the performance of all steps therein.

16. A method of net shaping raceways of rolling element bearing races of high performance rolling element bearings comprising the steps of:

(a) in a thermally controlled liquid working medium, rotating respectively on first and second generally parallel spaced axes, first and second rolling dies, each having an outer peripheral profiled surface, (b) rotatably supporting on a third axis generally parallel to the first and second axes within the thermally controlled liquid working medium a workpiece in the form of a near net shaped bearing race blank having a peripheral profiled rolling element engagement surface with a case in the metastable austenitic condition;

(c) crowning the engagement surfaces of the workpiece between spaced lateral surfaces and maintaining the engaging surfaces of rolling dies flat or crowning the engaging surfaces of the rolling dies and maintaining the engagement surfaces of the workpiece flat, then (d) positioning the workpiece so as to be coextensive with the first and second rolling finishing dies in the through feed direction;

(e) advancing the first and second rolling dies, within a common plane generally containing the first, second, and third axes, in respectively opposite in-feed directions substantially perpendicular to the third axis until the outer peripheral surfaces, respectively, of the first and second rolling dies engage the workpiece at opposed locations and at near net shaped center distances establishing initial center distances between the first and third axes when the workpiece and the rolling dies are initially engaged; and (f) continuing to advance at least one of the rolling dies in the in-feed direction by an additional increment of center distance thereby deforming the peripheral profiled engagement surface of the bearing race blank resulting in a final net shape of the rolling element engagement surface.

17. A method as set forth in claim 16 wherein step (d) includes the step of:

(g) advancing the workpiece along the third axis in a through-feed direction from a withdrawn position to an operative position at which the workpiece is positioned substantially coextensive with the first and second rolling dies in the through feed direction.

18. A method as set forth in claim 16 for net shaping the engagement surface of an inner race blank wherein the first and second rolling dies are both rolling finishing dies;

wherein the workpiece is an inner race blank including a peripheral profiled rolling element engagement surface with a case in the metastable austenitic condition; and wherein step (e) includes the step of:

(g) advancing the first and second rolling finishing dies until the outer peripheral surfaces, respectively, of the first and second rolling finishing dies engage the workpiece at diametrically opposed locations and at near net shaped center distances establishing initial center distances between the first and third axes and between the second and third axes, respectively, when the workpiece and the rolling dies are initially engaged.

19. A method as set forth in claim 18 wherein the workpiece has an outer peripheral profiled engagement surface which is slightly oversized from that of a desired formed engagement surface; and wherein each of the rolling finishing dies has an outer peripheral profiled surface which is substantially similar to that of the desired shape.

20. A method as set forth in claim 16 for net shaping the engagement surface of an outer race blank wherein the first rolling die is an outer support rolling die;

wherein the second rolling die is a rolling finishing die;

wherein the workpiece is an outer race blank including a ring-shaped member having an outer peripheral surface and an inner contoured roller element engagement surface; and wherein step (e) includes the steps of:

(g) advancing the first rolling die until the outer peripheral surface thereof tangentially engages the outer peripheral surface of the workpiece;

(h) advancing the second rolling die until the outer peripheral surface thereof tangentially engages the inner contoured rolling element engagement surface of the workpiece opposite the first rolling die and at near net shaped center distances establishing initial center distances between the first and third axes and between the second and third axes when the workpiece and the rolling dies are initially engaged; and (i) continuing to advance the second rolling die by an additional increment of center distance thereby deforming the peripheral profiled rolling element engagement surface resulting in a final net shape thereof.

21. A method as set forth in claim 20 wherein the workpiece has an inner peripheral profiled engagement surface which is slightly oversized from that of a desired formed engagement surface; and wherein the rolling finishing die has an outer peripheral profiled surface which is substantially similar to that of the desired shape.

22. A method as set forth in claim 16 including the step of:

(g) providing an inert atmosphere during the performance of all steps therein.

23. A method as set forth in claim 16

(g) providing an inert atmosphere during the performance of all steps therein.

24. A method of net shaping internal gear teeth of a high performance ring gear comprising the steps of:

(a) in a thermally controlled liquid working medium, rotating respectively on first and second generally parallel spaced axes, first and second rolling dies, each having an outer peripheral profiled surface, the first rolling die being an outer support rolling die, the second rolling die being a rolling gear die;

(b) rotatably supporting on a third axis generally parallel to the first and second axes within the thermally controlled liquid working medium a workpiece in the form of a ring gear blank including a ring-shaped member having an outer peripheral surface and inner near net shaped gear teeth surfaces with a hardened case; and (c) crowning the engagement surfaces of the workpiece between spaced lateral surfaces and maintaining the engaging surfaces of rolling dies flat or crowning the engaging surfaces of the rolling dies and maintaining the engagement: surfaces of the workpiece flat, then (d) positioning the workpiece so as to be coextensive with the first and second rolling dies in the through feed direction;

(e) advancing the first and second rolling dies, within a common plane generally containing the first, second and third axes, in respectively opposite in-feed directions substantially perpendicular to the third axis;

(f) continuing to advance the first rolling die until the outer peripheral surface thereof tangentially engages the outer peripheral surface of the workpiece;

(g) continuing to advance the second rolling die until the outer peripheral surface thereof engages the gear teeth surfaces of the workpiece opposite the first rolling die and at near net shaped center distances establishing initial center distances between the first and third axes when the workpiece and the rolling dies are initially engaged; and (h) continuing to advance the second rolling gear die by an additional increment of center distance thereby deforming the outer profiled surfaces of each gear tooth resulting in final net shape of the internal gear teeth.

25. A method as set forth in claim 24 wherein step (d) includes the step of:

(i) advancing the workpiece along the third axis in a through-feed direction from a withdrawn position to an operative position at which the workpiece is positioned substantially coextensive with the first and second rolling dies in the through feed direction.

26. A method as set forth in claim 24 wherein the workpiece has gear teeth surfaces which are slightly oversized from those of desired formed engagement surfaces; and wherein the roll finishing die has an outer peripheral profiled surface which is substantially similar to that of the desired shape.

27. Apparatus for net shaping raceways of high performance rolling element bearing races comprising:

means for heating a workpiece in the form of a near net shaped bearing race blank having a rolling element engagement surface with a case above its critical temperature to obtain an austenitic structure throughout its case, the engagement surface intended for engagement by a plurality of rolling elements;

first quenching means for isothermally quenching the workpiece at a rate greater than the critical cooling rate of its case to a uniform metastable austenitic temperature above the martensitic transformation temperature;

opposed rolling dies, each having an outer peripheral profiled surface, for rolling the engagement surface to a desired shape while holding the temperature of the workpiece at the uniform temperature before martensitic transformation occurs, the outer peripheral surface of the rolling dies being crowned and the engagement surface of the workpiece being flat or the engagement surface of the workpiece being crowned and the outer peripheral profiled surface of the rolling dies being flat; and second quenching means for cooling the workpiece through the martensitic range to harden the engagement surface.

28. Apparatus as set forth in claim 27 wherein the first quenching means includes a thermally controlled liquid working medium for receiving the workpiece; and including:

actuator means including transfer means for rapidly transferring the workpiece from a first position whereat the workpiece is proximate the heating means to a second position whereat the workpiece is submerged in the thermally controlled liquid working medium.

29. Apparatus as set forth in claim 27 including:

an enclosure providing an inert atmosphere during the performance of all operations performed on the workpiece.

30. Apparatus as set forth in claim 27 wherein the heating means includes:

a first toroidal shaped induction heater defining a first heating zone;

a second toroidal shaped induction heater defining a second heating zone;

wherein the actuator means includes:

means for rapidly transporting the workpiece from the first heating zone to the second heating zone, then into the liquid working medium;

means for rotatably supporting the workpiece within the first heating zone so as to be coaxial with the first induction heater and for rotatably supporting the workpiece within the second heating zone so as to be coaxial with the second induction heater; and drive means for rotating the workpiece on its axis of rotation within the first heating zone at a first rotational speed and for rotating the workpiece on its axis of rotation within the second heating zone at a second rotational speed.

31. Apparatus as set forth in claim 27 wherein the heating means includes:

means for energizing the first induction heater at a frequency effective to impart adequate heat to the first heating zone to thereby heat the workpiece to an elevated surface temperature resulting in a desired thermal gradient at least through the hardened case surface of the workpiece; and means for energizing the second induction heater at a frequency effective to impart adequate heat to the second heating zone to thereby heat the engagement surface of the workpiece above its critical temperature to obtain the austenitic structure.

32. Apparatus as set forth in claim 30 wherein the first induction heater operates at a frequency in the range of approximately 2 to 20 kHz; and wherein the second induction heater operates at a frequency in the range of approximately 100 to 450 kHz.

33. Apparatus as set forth in claim 28 wherein the actuator means includes:

a support spindle for rotatably supporting the workpiece; and chuck means on the spindle selectively adjustable between a retracted position for free reception into a central opening of the workpiece and an expanded condition for firmly holding the workpiece on the spindle.

34. Apparatus as set forth in claim 33 wherein the transfer means includes:

a linear actuator operable for selectively moving the spindle longitudinally between and among a fully retracted position, a loading position whereat the workpiece is releasably mounted on the spindle, a first heating position whereat the workpiece is positioned within the first heating zone, a second heating position whereat the workpiece is positioned within the second heating zone, and a quench position whereat the workpiece is submerged in the liquid working medium.

35. Apparatus as set forth in claim 27 wherein the heating means includes:

a toroidal shaped induction heater defining a heating zone;

wherein the actuator means includes:

means for rapidly transporting the workpiece from the heating zone into the liquid working medium;

means for rotatably supporting the workpiece within the heating zone so as to be coaxial with the induction heater; and drive means for rotating the workpiece on its axis of rotation within the heating zone at a first rotational speed and for rotating the workpiece on its axis of rotation within the heating zone at a second rotational speed.

36. Apparatus as set forth in claim 35 wherein the heating means includes:

means for energizing the induction heater at a first frequency effective to impart adequate heat to the heating zone to thereby heat the workpiece to an elevated surface temperature resulting in a desired thermal gradient at least through the engagement surface of the workpiece; and means for energizing the second induction heater at a frequency effective to impart adequate heat to the second heating zone to thereby heat the engagement surface of the workpiece above its critical temperature to obtain the austenitic structure.

37. Apparatus as set forth in claim 36 wherein the induction heater operates at the first frequency in the range of approximately 2 to 20 kHz; and wherein the second induction heater operates at the second frequency in the range of approximately 100 to 450 kHz.

* * * * *